US005110450A

United States Patent [19]

Culross et al.

[11] Patent Number: 5,110,450

[45] Date of Patent: May 5, 1992

[54] COAL EXTRACT HYDROCONVERSION PROCESS COMPRISING SOLVENT ENHANCED CARBON MONOXIDE PRETREATMENT

[75] Inventors: Claude C. Culross; Steve D. Reynolds, both of Baton Rouge, La.

[73] Assignee: Exxon Research and Engineering Company, Florham Park, N.J.

[21] Appl. No.: 455,653

[22] Filed: Dec. 21, 1989

[51] Int. Cl.[5] ..... C10G 1/02

[52] U.S. Cl. ..... 208/413; 208/412; 208/414; 208/420; 208/424; 208/430; 208/433; 208/435

[58] Field of Search ..... 208/430, 433, 427, 420, 208/435, 412, 414, 424

[56] References Cited

U.S. PATENT DOCUMENTS

| | | | |
|---|---|---|---|
| 3,642,607 | 2/1972 | Seitzer | 208/433 |
| 3,808,119 | 4/1974 | Bull et al. | 208/433 |
| 3,930,984 | 1/1976 | Pitchford | 208/433 |
| 4,077,807 | 3/1978 | Aldridge et al. | 208/421 X |
| 4,260,471 | 4/1981 | Miller | 208/433 |
| 4,298,451 | 11/1981 | Neuworth | 208/433 X |
| 4,330,390 | 5/1982 | Rosenthal et al. | 208/430 X |
| 4,338,183 | 7/1982 | Gatsis | 208/430 |
| 4,491,511 | 1/1985 | Skinner et al. | 208/433 X |
| 4,522,700 | 6/1985 | Schindler | 208/434 |
| 4,523,986 | 6/1985 | Seufert | 208/427 |
| 5,026,475 | 6/1991 | Stuntz et al. | 208/414 |

FOREIGN PATENT DOCUMENTS

| | | | |
|---|---|---|---|
| 0264743 | 4/1988 | European Pat. Off. | 208/433 |

*Primary Examiner*—Anthony McFarlane
*Attorney, Agent, or Firm*—C. P. Konkol; Roy J. Ott

[57] ABSTRACT

An improved process for the hydroconversion of coal, wherein coal is slurried in an organic solvent and subjected to pretreatment with carbon monoxide, followed by separation of a solvent-soluble phase comprising hydrocarbon material from the coal, and subsequently hydroconverting the extracted material in a hydroconversion reactor. The extracted material consists of a relatively hydrogen-rich material which is readily hydroconverted to valuable liquid products in high yield. The coal residue is relatively hydrogen deficient material which can be gasified to produce hydrogen and carbon monoxide for the hydroconversion and pretreatment stages, respectively.

17 Claims, 3 Drawing Sheets

COAL EXTRACT HYDROCONVERSION PROCESS COMPRISING SOLVENT ENHANCED CARBON MONOXIDE PRETREATMENT

The invention relates to a process for liquefying coal, in particular, a multi-stage process comprising in sequence a pretreatment stage, an extraction stage, and a catalytic hydroconversion stage.

BACKGROUND OF THE INVENTION

1. Field of the Invention

The petroleum industry has long been interested in the production of "synthetic" liquid fuels from non-petroleum solid fossil fuel sources. It is hoped that economic non-petroleum sources of liquid fuel will help the petroleum industry to meet growing energy requirements and decrease dependence on foreign supplies.

Coal is the most readily available and most abundant solid fossil fuel, others being tar sands and oil shale. The United States is particularly richly endowed with well distributed coal resources. Addi-tionally, in the conversion of coal to synthetic fuels, it is possible to obtain liquid yields of about three to four barrels per ton of dry coal, or about four times the liquid yield/ton of other solid fossil fuels such as tar sands or shale, because these resources contain a much higher proportion of mineral matter.

Despite the continued interest and efforts of the petroleum industry in coal hydroconversion technology, further improvements are necessary before it can reach full economic status. Maximizing the yield of coal liquids is important to the economics of coal hydroconversion.

The present invention relates to an improved process for converting coal to liquid hydrocarbon products in a catalytic hydroconversion process. The improvement relates to a coal pretreatment stage comprising subjecting a slurry of coal, dispersed in an organic solvent, to carbon monoxide under specific pressure and temperature conditions. This pretreatment results in a higher reactivity of an extract of the pretreated coal in the subsequent hydroconversion stage.

2. Description of the Prior Art

The known processes for producing liquid fuels from coal can be grouped into four broad categories: direct hydrogenation, donor solvent hydrogenation, Fischer-Tropsch synthesis (via gasification), and pyrolysis (see Kirk Othmer —Fuels).

The direct hydrogenation of coal in the presence of solvent and catalyst was first developed in Germany prior to World War II. In such a process, a slurry of coal in a suitable solvent was reacted in the presence of molecular hydrogen at an elevated temperature and pressure.

A number of previous co-assigned patents disclose coal liquefaction processes utilizing hydroconversion catalysts which are micron-sized particles comprised of a metal sulfide in a carbonaceous matrix. These catalysts are generally formed from certain soluble or highly dispersed organometallic compounds or precursors. These precursors are converted into catalyst particles by heating in the presence of an hydrogen-containing gas. The catalyst particles are highly dispersed in the feed being treated during hydroconversion. Among the various patents in this area are U.S. Pat. No. 4,077,867; U.S. Pat. No. 4,094,765; U.S. Pat. No. 4,149,959; U.S. Pat. No. 4,298,454; and U.S. Pat. No. 4,793,916. Other patents disclose catalysts similar to the above except that the catalytically active metal compound is supported on finely divided particles of solid metals and metal alloys, for example as disclosed in U.S. Pat. Nos. 4,295,995 and 4,357,229.

The conversion of coal in the presence of high temperature steam and carbon monoxide is well known, dating back to Fischer and Schrader in 1921 (F. Fisher & H. Schrader, Bennst. Chem., 2, 257, 1921). Several hydroconversion processes, including the U.S. Bureau of Mines COSTEAM process (H. R. Appell, E. C. Moroni, R. D. Miller, Energy Sources, 3, 163, 1971), have been developed based on using steam/carbon monoxide or steam/syngas at 750–850° F. in a primary conversion block.

One of the problems encountered in coal hydroconversion is the separation of slurried catalyst from solid by-products, such as undissolved organic coal and ash. Such solid materials are typically dispersed throughout the reaction mixture during the hydroconversion operation, and are thus present in the coal liquid recovered after hydroconversion. Such solid materials are present in the coal liquids in a finely divided, particulate state, and are typically separated from the coal liquid products by distillation.

Another problem inherent in coal hydroconversion processes has been the requirement for large amounts of hydrogen. It has been suggested that this problem of hydrogen consumption could be reduced by converting only a relatively small fraction of the coal, which fraction is rich in hydrogen. However, to be economical, there is a need for a process which converts a relatively large fraction of the coal to valuable liquid hydrocarbon products. The present process, while not necessarily reducing the requirement for hydrogen, allows coal to be taken to a higher conversion level. Hydrogen utilization is therefore more efficient. For a given amount of liquid products less gas is produced, resulting in a better liquid to gas selectivity.

An object of the present invention is to provide a novel process for the hydroconversion of coal in order to produce valuable liquid hydrocarbonaceous products.

A further object of the present invention is to provide an improved process for producing liquid hydrocarbonaceous products from coal by utilizing a pretreatment step wherein the coal, slurried in an organic solvent phase, is subjected to reaction with carbon monoxide.

A still further object of the present invention is to pretreat coal in a specific temperature range to enhance extraction and generate a more reactive coal material for hydroconversion, thereby obtaining more product, with better liquid to gas selectivity.

Another object of the present invention is to improve the utilization efficiency of molecular hydrogen, in the transformation of coal to valuable liquids, by hydrogenating less of the original coal feed, as well as effecting better liquid-to-gas selectivity.

Still another object of the present invention is to liquefy coal by a process comprising in sequence a pretreatment stage, an extraction stage (ex-situ or in-situ), and a catalytic hydroconversion stage.

Additional advantages of the present coal hydroconversion process will become apparent in the following description.

SUMMARY OF THE INVENTION

In accordance with the present invention, there is provided a process for liquefying coal to produce an oil, comprising: (a) forming a mixture comprising coal, carbon monoxide and an organic solvent in a pretreatment zone and subjecting the mixture to a temperature and pressure effective to cause mild depolymerization of the coal; (b) removing gases from the coal mixture in a separation zone; (c) extracting the pretreated coal with an organic solvent in an extraction zone to obtain an extract comprising a substantial amount of soluble hydrocarbonaceous coal; (d) forming a subsequent mixture of said extract and a catalyst wherein the catalyst comprises a sulfided metal-containing compound, said metal being selected from the group consisting of Groups VA, VIA, VIIA and VIIIA of the Periodic Table of Elements and mixtures thereof; and (e) reacting the mixture of coal extract and catalyst with hydrogen under coal hydroconversion conditions in a hydroconversion zone to obtain a hydrocarbonaceous liquid product.

In accordance with another embodiment of the invention, there is provided a process for liquefying coal to produce an oil, which comprises: (a) subjecting a mixture of coal, organic solvent and carbon monoxide to a temperature of 550° F. to 700° F. and a carbon monoxide partial pressure of 500 to 5000 psi for a period of at least 10 minutes. (b) removing gases from the coal mixture; (c) extracting the pretreated coal with an organic solvent in an extraction zone to obtain an extract comprising a substantial amount of soluble hydrocarbonaceous coal; (d) forming a subsequent mixture of said extract, an organic solvent, preferably coal derived, and a catalyst, wherein the catalyst comprises a sulfided metal compound and has an average particle size of 0.02 to 2 microns, preferably a conversion product of an organic oil-soluble metal containing compound, said metal being selected from the group consisting of Groups VA, VIA, VIIA and VIIIA of the Periodic Table of the Elements and mixtures thereof; and (e) reacting the latter mixture with a gas comprising molecular hydrogen under coal hydroconversion conditions, in a hydroconversion zone to obtain a hydrocarbonaceous liquid product.

BRIEF DESCRIPTION OF DRAWINGS

The process of the invention will be more clearly understood upon reference to the detailed discussion below and upon reference to the drawings wherein.

DESCRIPTION OF THE PREFERRED EMBODIMENTS

Figure 1:
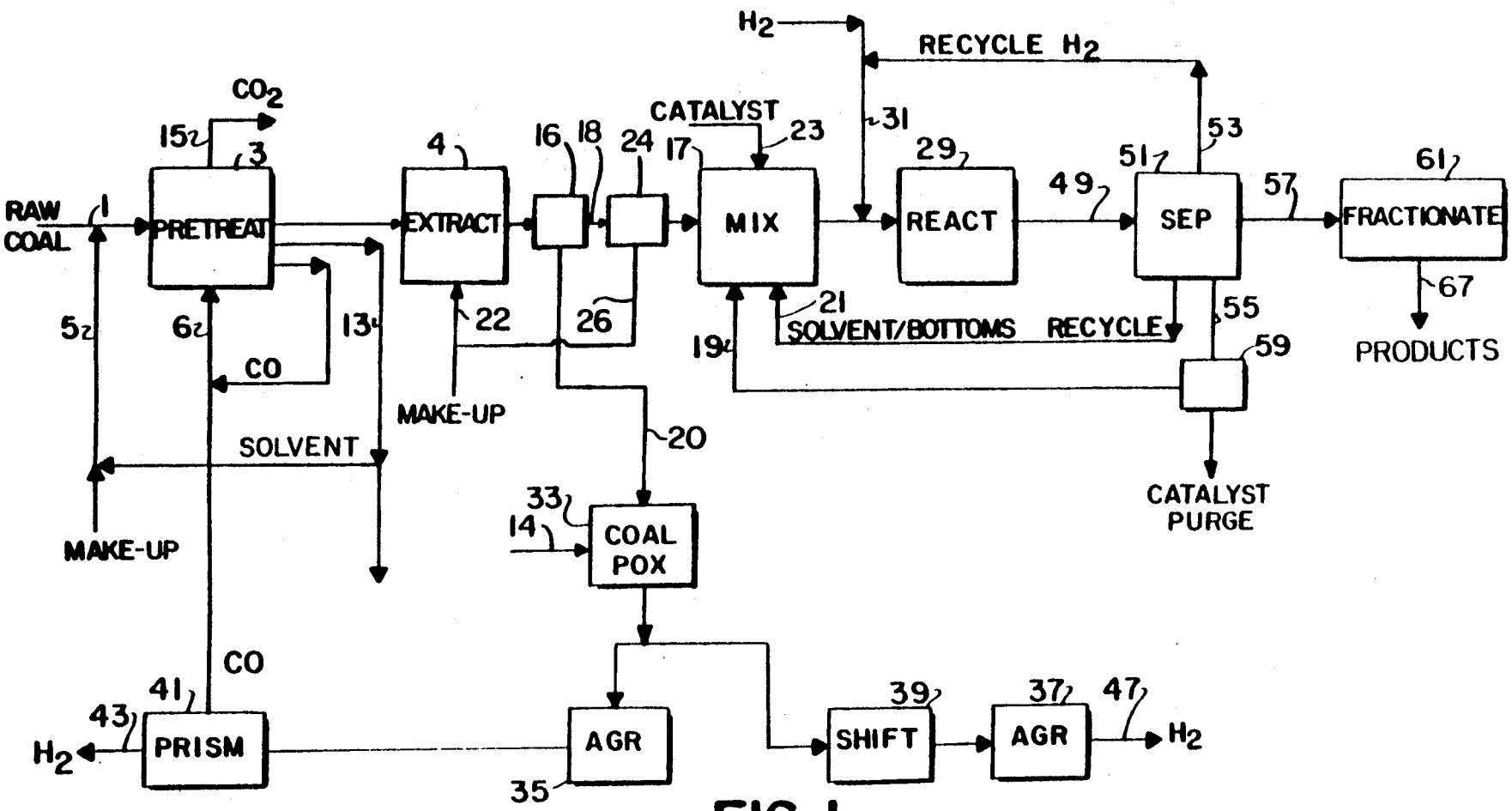
FIG. 1 shows a process flow diagram illustrating the subject invention wherein coal is pretreated in the presence of carbon monoxide in an organic solvent and thereafter converted into valuable liquids.

The process of the invention is generally applicable to hydroconvert coal to coal liquids (i.e., an oil or normally liquid hydrocarbonaceous product). The process comprises a pretreatment stage, an extraction stage and a catalytic hydroconversion stage. In the pretreatment stage, a coal feed is pretreated with carbon monoxide (or a gaseous mixture such as syngas containing carbon monoxide) in an organic solvent at an elevated temperature and pressure. In the extraction stage, the pretreated coal is extracted with an organic solvent, either in-situ or following pretreatment, to produce an essentially ash-free hydrocarbonaceous extract (typically less than 1% ash by weight) before further catalytic upgrading. Separation of this extract from the ash residue of the coal prior to further hydroconversion greatly facilitates catalyst recovery. Even weight % loadings of catalyst are permitted in the upgrading or hydroconversion zone, leading to an improved product state and product quality. Specifically, the present coal hydroconversion process is capable of providing a higher liquid to gas selectivity. The extraction stage also yields a hydrogen-enriched fraction requiring less hydrogen at constant conversion and produces a hydrogen lean, catalyst-free ash residue reject for partial oxidation or combustion. This residue contains less hydrogen per gram than the raw coal.

The term "coal" is used herein to designate a normally solid carbonaceous material including all ranks of coal below anthracite, such as bituminous coal, sub-bituminous coal, lignite, peat and mixtures thereof. The sub-bituminous and lower ranks of coal are particularly preferred.

The raw material for the present process is coal that has been first reduced to a particulate or comminuted form. The coal is suitably ground or pulverized in a conventional ball mill to provide particles of a size ranging from 10 microns up to about ¼ inch particle size diameter, typically about 8 mesh (Tyler).

Pretreatment. According to the process, a feedstock such as brown coal, lignite, sub-bituminous coal or bituminous coal, dispersed in an organic solvent, is subjected to carbon monoxide during pretreatment. Coal is reacted in the pretreatment stage at relatively mild temperatures. A limited amount of volatile hydrocarbon liquids are produced. However, the coal is depolymerized, and the equilibrium moisture and oxygen levels are reduced. After such pretreatment, not only are the properties of the coal upgraded, but the coal shows enhanced reactivity for further processing. In particular, the pretreatment significantly increases the coal's value as feedstock for coal hydroconversion. The severity of the coal hydroconversion reduction can be reduced while increasing liquid yields, reducing gas make, and lowering hydrogen consumption, although it is more economically favorable to maintain hydroconversion severity so as to maximize conversion. The coal can reach a significantly higher daf weight % (dry ash free weight %) conversion following pretreatment.

During pretreatment, coal depolymerization reactions occur. Depolymerization is detected by an increased solubility of the coal in various solvents. The ability of pretreatment to depolymerize coal has been variously attributed to bond breaking activity, or to the removal of potential cross-link sources which cause repolymerization to higher molecular weight products following thermal bond rupture.

During pretreatment, the coal in the form of particles is dispersed in an organic solvent which serves to transport carbon monoxide to the coal material. Although, in general, the presence of bulk water in addition to organic solvent will not adversely affect the benefits of pretreatment (increased coal volatile matter and improved reactivity during hydroconversion), it is preferred that the coal particles are dispersed in a single liquid phase comprising an organic solvent such as a coal distillate.

Some water is required for the pretreatment reaction system in order to provide for hydrogenation of the coal material. However, the water may be provided by the as-received coal equilibrium moisture (also called "physical water") and/or by chemical water in the coal ("chemical water" is water made available during the conditions of pretreatment and may comprise water of hydration in the coal minerals). One proposed reaction mechanism is that during pretreatment the carbon monoxide reacts with water in the coal matrix and forms reactive intermediates which hydrogenate the coal and generate carbon dioxide.

In practice, the present process requires no water to be added to the as-received coal, and no liquid water phase is necessary during pretreatment. Typically, about 30% by weight water may be present as moisture in the as-received coal, but this is insufficient to form an aqueous phase during pretreatment. Higher amounts of water, for example, in lignite, may be present and, although not preferred, is generally not detrimental to pretreatment. However, hydroconversion reactivity of the coal may suffer when both organic solvent and water are present at intermediate levels.

A major benefit of the present process is that, since additional water is not required during pretreatment, no separation by filtration of liquid water from the pretreated coal is necessary, after it exits the pretreatment reactor. Separation of water from the pretreated coal suitably occurs in the gas phase by interstage gas separation rather than by filtration.

The ratio by weight of organic solvent-to-dry coal, is suitably 4:1 to 1:1, preferably about 3:1 to 1.5:1. The ratio of water-to-dry coal at conditions is below about 0.5:1 and the inlet ratio of water-to-dry coal is below about 1:1. (The term "at conditions", as compared to "inlet conditions", excludes water evaporated to steam, and water lost via the water-gas-shift reaction.)

Preferably, the coal during pretreatment is slurried with a process-derived hydrocarbon solvent suitable for ultimate use in the liquefaction stage. Exemplary solvents are 400° F.+distillates up to and including VGO solvent and recycle liquefaction bottoms.

The pretreatment temperature has a large impact on the quality of coal. A temperature within the range of 550° F. to 700° F. is critical, with 600° F. to 675° F. being preferred, and 600° F. to 650° F. most preferred.

Another important pretreatment process condition is carbon monoxide (CO) pressure and the amount fed relative to coal. There is generally an increasing improvement in coal properties with increasing CO partial pressure ($P_{co}$). A suitable range is 500 to 1500 psi (initial) at ambient temperature, preferably about 850 to 1000 psi. There is also generally an increasing improvement in coal properties with increasing weight % CO fed relative to coal, or "treat". A suitable treat range is 40 to 100 weight % (dry coal basis), preferably about 60–90 weight % CO.

The total pressure at conditions (including $H_2O$ vapors, $CO_2$, $H_2$, CO, and $C_1$–$C_4$) is suitably in the range of about 1800 to 4500 psi, preferably about 2800 to 4500 psi, depending on $P_{co}$ and the temperature, which in turn determines the solvent partial pressure.

Generally, coal quality improves with increasing residence time in the pretreatment zone. A suitable residence time at 650° F. ranges from about 10 minutes to 5 hours, preferably, from an economic standpoint, 20 minutes to 2 hours.

Efficient mixing and good contact between the CO and coal in the pretreatment reactor is desirable. This can be accomplished with a mechanical stirrer and/or with stationary baffles that create high turbulence, or properly designed inlet gas sparges that produce small gas bubbles.

Pretreatment of coal according to the present invention is suitably carried out in a reactor of conventional construction and design capable of withstanding the heretofore described conditions of pretreatment. A stainless steel cylindrical vessel with inlet lines for the coal slurry and carbon monoxide and product removal lines is suitable.

Recycle of solvent phase compounds to the pretreatment reactor is an optional feature which can provide certain advantages. Recycle may aid in dissolution of the coal as a result of the low molecular weight organic solvents (e.g., alcohols, phenols, and carboxylic acids) contained in the recycle solution.

Certain soluble acids or metal salts of acids or bases, particularly those made in the reaction system during pretreatment, all can act as promotors to enhance the pretreatment of the coal by improving coal solubility at a given temperature and pressure. The most preferred promotors are sodium or calcium formate. Other preferred promotors are ammonium sulfide or ammonium bisulfide or hydrogen sulfide. The promotors should be present in the aqueous system in the amount by weight of 0.5 to 50%, preferably 0.5 to 10%, and most preferably 1 to 5% (on dry coal). As indicated below, these promotors may be sprayed in an aqueous solution onto the crushed coal.

During pretreatment, the coal is subjected to extraction wherein soluble carbonaceous material is extracted from the pretreated coal by the organic solvent. Optionally, additional solvent or a different solvent can be added following pretreatment and the coal subjected to further extraction. The extracted material is separated from the ash-containing residue by settling and filtration or other means.

Extraction of the coal particles in effect fractionates the components of the coal material according to its hydrogen to carbon ratio and molecular weight. In general, the more hydrogen rich or lower in molecular weight the component, the greater its solubility in the solvent. Because of the higher hydrogen content of the extracted material, higher conversion and greater selectivity in the subsequent hydroconversion is obtained. On the other hand, the residue is more hydrogen deficient than the feed coal to pretreat.

By extraction and separation, the raw coal feedstock can thereby split into two fractions. The first fraction, containing the ash residue, suitably contains 0 to 40% of the daf (dry ash free) pretreated coal material. A second fraction, containing the coal extract and essentially ash free (an ash content of less than 2%, preferably less than 1% by weight), suitably contains 60 to 100% of the daf pretreated coal material. For example, with a typical Wyoming coal, the coal to pretreat may have an H/C ratio of 0.82, the extract-containing fraction may have an H/C ratio of 0.97 and the residue-containing fraction may have an H/C ratio of 0.77 (with an ash content of greater than 25%).

The ash-containing fraction is preferably sent to a partial oxidation unit to supply carbon monoxide and hydrogen to the integrated process. The other fraction, containing the coal extract and solvent, is introduced into a hydroconversion zone where the coal extract is converted into lighter products. Optionally, part or all of the extraction solvent may be removed by distillation prior to sending the extract to the hydroconversion stage, although it may be more convenient to send the solvent to extraction. Additional solvent or recycle solvent may also be admixed with the coal slurry and sent to the hydroconversion zone.

In practice, a 650° F+ extraction solvent and 650° F.+ hydroconversion product are fed to the hydroconversion reactor to the extent needed to produce a net 650+ F.− product by extinction of 650° F.+ product. A sufficient amount of VGO is set aside for the purpose of extraction. As mentioned above, the extract is substantially enriched in hydrogen, and the residue is depleted in hydrogen, relative to the feed coal to pretreatment.

The present process provides an advantage over other hydroconversion processes in that the hydrocarbonaceous stream sent to the hydroconversion zone is essentially ash free even when handling high ash coals. The amount of ash is preferably less than about 1%, most preferably less than 0.1% by weight. Furthermore, the hydroconversion feed (comprising the extract from pretreated coal) is enriched in hydrogen and is more readily converted with better liquid/gas selectivity in the hydroconversion step than unfractionated pretreated coal.

Another benefit is that less total material is sent to the reactor, since ash and other unusable material are removed beforehand. Therefore, additional reactor volume is available to achieve higher conversion by longer residence time. Still another benefit of the present process is that the ashless coal extract is easier to handle than a solids-liquids mixture. For example, separations can usually be accomplished by a simple distillation.

When compared on the basis of feed coal to pretreatment, the present process, during subsequent hydroconversion, generates as much or more of the desirable liquid products (and less gas), that is more naphtha and distillate, as other coal hydroconversion processes, even though significantly less hydrocarbon material is sent to the upgrading step. Extraction and liquid-solid separation of the coal results in the worst 15% to 25% of the coal (daf pretreated) being selectively diverted to a partial oxidation unit and the remainder almost entirely converted. That is, of the approximately 75% to 85% of the original coal material going to hydroconversion, virtually 100% can be converted. It is believed that more distillate and vacuum gas oil (VGO) is obtainable in the present process. Even without up to 25% of the original coal going to the hydroconversion, it is possible to obtain a higher conversion to 1000° F.− liquids on a coal feed to pretreatment basis than with no extraction and no separating out of solid residue. Moreover, this higher liquid conversion is possible with a lower hydrogen consumption in the hydroconversion step.

Preferably, the process conditions are set such that the carbon content of the ash-containing residue meets process requirements for obtaining $H_2$ and CO from partial oxidation. A typical 30% to partial oxidation and 70% to hydroconversion split of the coal following pretreatment generally accomplishes this goal. Alternately, in the case where the carbon content is low, the residue may either be oxidized or combusted for heat.

As mentioned before, additional extraction of coal solubles can occur either in a separate extraction stage following pretreatment, or solely during pretreatment.

Hydroconversion. Following coal pretreatment, extraction, and liquid-solid separation, the extracted components of the coal are subjected to hydroconversion to produce lighter products. The solvents employed in the hydroconversion stage of the present invention, which may include the pretreatment organic solvent, may contain anywhere from ½ to about 2 weight % donatable hydrogen, based on the weight of the total solvent. Preferred solvents include coal derived liquids and coal distillates or mixtures thereof, for example, a mixture of compounds having an atmospheric boiling point ranging from about 350° F. to about 1050° F., more preferably ranging from about 650° F. to less than about 1000° F.

The preferred solvent is vacuum gas oil (VGO), since it is most like the material extracted, and its high boiling range allows the extraction to proceed with little or no reactor pressure even at higher temperatures. It is also a good choice because it has relatively less value as a product and can be sent to partial oxidation without expensive losses (typically less than about 10% of the VGO can be lost to partial oxidation without economic concerns). Coal derived VGO boils in the range of about 650° F. to 1000° F.

Other suitable solvents include aromatic compounds such as alkylbenzenes, alkylnaphthalenes, alkylated polycyclic aromatics, heteroaromatics, unhydrogenated or hydrogenated creosote oil, tetralin intermediate product streams from catalytic cracking of petroleum feedstocks, shale oil, or virgin petroleum streams such as vacuum gas oil or residuum etc. and mixtures thereof.

The catalyst is suitably a conventional supported (i.e. fixed bed) metal sulfide containing catalyst. Preferably, the catalyst employed in the hydroconversion stage is comprised of well-dispersed, micron or submicron size particles. Preferably, the catalyst is a sulfided metal containing compound. Most preferably, the catalyst is formed from a precursor which is an organic oil-soluble metal compound. The precursor is typically added to the solvent after extraction and before upgrading, so as to form a mixture of oil soluble metal compound, solvent and coal in a mixing zone.

Suitable oil-soluble metal compounds convertible to active catalysts under process conditions include (1) inorganic metal compounds such as halides, oxyhalides, hydrated oxides, heteropoly acids (e.g., phosphomolybdic acid, molybdosilicic acid); (2) metal salts of organic acids such as acyclic and alicyclic aliphatic carboxylic acids containing two or more carbon atoms (e.g., naphthenic acids); aromatic carboxylic acids (e.g., toluic acid); sulfonic acids (e.g., toluenesulfonic acid); sulfinic acids; mercaptans, xanthic acid; phenols, di- and polyhydroxy aromatic compounds; (3) organometallic compounds such as metal chelates (e.g., with a 1,3-diketone, ethylene diamine, ethylene diamine tetraacetic acid, dithiocarbamate, xanthate, etc.); (4) metal salts of organic amines such as aliphatic amines, aromatic amines, and quaternary ammonium compounds.

The metal constituent of the oil soluble metal compound is selected from the group consisting of Groups VA, VIA, VIIA and VIIIA of the Periodic Table of Elements, and mixtures thereof, in accordance with the Table published by Sargent-Welch Scientific Company, copyright 1979, that is, vanadium, niobium, tantalum, chromium, molybdenum, tungsten, manganese, rhenium, iron, cobalt, nickel and the noble metals including platinum, iridium, palladium, osmium, ruthenium and rhodium. The preferred metal constituent of the oil soluble metal compound is selected from the group consisting of molybdenum, vanadium, chromium, nickel and cobalt. More preferably, the metal constituent of the oil soluble metal compound is selected from the group consisting of molybdenum, nickel, and cobalt. Preferred compounds of the metals include the salts of acyclic (straight or branched chain) aliphatic carboxylic acids, salts of alicyclic aliphatic carboxylic acids, heteropolyacids, hydrated oxides, carbonyls, phenolates and organic amine salts. More preferred types of metal compounds are the heteropoly acids, e.g., phosphomolybdic acid (PMA). Another preferred metal compound is a salt of an alicyclic aliphatic carboxylic acid such as a metal naphthenate. Preferred compounds are molybdenum naphthenate, vanadium naphthenate, nate, chromium naphthenate, and molybdenum-, cobalt-, or nickel-dibutyl diothiocarbamates or xanthates. Iodine may be used as a catalyst.

The preferred catalyst particles, containing a metal sulfide in a hydrocarbonaceous matrix formed within the process, are uniformly dispersed throughout the feed. Because of their ultra small size, there are typically several orders of magnitude more of these catalyst particles per cubic centimeter of oil than is possible in an expanded or fixed bed of conventional catalyst particles. The high degree of catalyst dispersion and ready access to active catalyst sites affords good reactivity control of the reactions.

Since such catalysts are effective at weight parts per million quantities of metal on feed, it is economically feasible to use than without recovery from the bottoms purge stream. Most of the catalyst returns to the upgrading reactor with the bottoms recycle stream. Only a small amount of "makeup" catalyst needs to be added.

The catalyst loading is flexible, ranging from parts per million (ppm) to weight percents (the latter limited by pumping constraints in a slurry reactor). Higher catalyst loadings increase conversion to low boiling liquids, and decrease heteroatom content, with better selectivity to liquid over gas. The catalyst may be used in the slurry mode or, with an essentially ash free extract, in a fixed bed. Conditions may be varied to produce a more or less saturdated/hydrocracked product suitable as (or for conversion to) diesel or mogas, respectively. Mild hydroconversion temperatures in the range of 650–800° F. are preferably used.

Normal catalyst loadings on the order of 1000 ppm, ranging from 100 to 5000 ppm, are suitable for the hydroconversion reaction system of the present process. The oil-soluble metal-containing compound make-up (not including additional amounts from recycle) is added in an amount sufficient to provide from about 10 to less than 5000 wppm, preferably from about 25 to 950 wppm, more preferably, from about 50 to 700 wppm, most preferably from about 50 to 400 wppm, of the oil-soluble metal compound, calculated as the elemental metal, based on the weight of dry coal in the mixture. Catalyst make-up rates are suitably from about 30 ppm to 500 ppm on coal. The remainder will normally be supplied from recycling the catalyst containing unconverted coal extract or bottoms.

A significant advantage of high catalyst loadings, however, counterbalanced to some extent by increasing catalyst material and process costs, is that a nearly finished product is produced. By high catalyst loadings is meant from between 1 and 10 weight%, preferably between about 1 and 5%. (A figure of 1% equals 10,000 ppm). By nearly finished product is meant liquids characterized by low heteroatom levels. With high catalyst loadings, a typical product has less than about 5 ppm nitrogen, 194 ppm sulfur, 1300 ppm oxygen and a hydrogen to carbon ratio of at least about 1.7. The significance of obtaining a nearly finished product is that it may obviate a second upgrading reactor (e.g. hydrotreatment, hydrodesulfurization, or hydrodenitrogenation) which is usually a large part of the overall process cost and consumes substantial amounts of hydrogen, one of the more expensive reagents in a refinery. Catalyst levels could be selected to achieve a nearly finished product characterized by a nitrogen level of about 0 to 1500 ppm, a sulfur level of 200 to 400 ppm, and an oxygen level of about 1300 to 15,000 ppm, making the product suitable as feed for fluid catalytic cracking which does not require a high pressure hydrogen atmosphere. Suitably, at least 50% by weight, preferably at least about 90% of the nitrogen, sulfur and oxygen in the coal extract is removed by employing high catalyst loadings.

The benefits obtained by utilizing relatively high catalyst loadings, in the form of a catalyst slurry during hydroconversion, are realized without having to deal with a difficult catalyst recovery or recycle step, since as a result of the previous extraction stage, the hydroconversion zone is very low in ash and there are almost no bottoms from the hydroconversion step. Without the extraction stage, substantial catalyst would be lost, since, as a result of the need to prevent the build-up of ash, a portion of the bottoms is flushed out taking along a proportional amount of the catalyst. Although in principle the catalyst can first be separated from the bottoms, there is currently no economical method of doing this. In the present process, almost 100% of the catalyst can be recycled with no difficulty. The high catalyst loadings result in obtaining a nearly finished product, which means that some or all secondary upgrading steps can be eliminated and the economics greatly enhanced.

Various methods can be used to convert a catalyst precursor, in the coal-solvent slurry, to an active catalyst. It is usually better to form the catalyst after dissolving the soluble precursor in order to obtain better dispersion. One method of forming the catalyst from the precursor or oil-soluble metal compound is to heat in a premixing unit prior to the hydroconversion reaction, the mixture of metal compound, coal extract and solvent to a temperature ranging from about 600° F. to about 840° F. and at a pressure ranging from about 500 to about 5000 psig, in the presence of a hydrogen-containing gas. A sulfur-containing reagent such as $H_2S$, $CS_2$ (liquid), or elemental sulfur should be introduced. The hydrogen-containing gas may be pure hydrogen but will generally be a hydrogen stream containing some other gaseous contaminants, for example, a hydrogen-containing stream produced from the effluent gas in a reforming process.

Another method of forming the catalyst is to add the catalyst precursor to the pretreatment step. This will only work when the following extraction is the "presoak" option, i.e. no filtration. Filtration would remove the catalyst particles.

If $H_2S$ is employed as the source of sulfur to activate the catalyst, then the hydrogen sulfide may suitably comprise from about ½ to about 10 mole % of the hydrogen-containing gas mixture. Hydrogen sulfide may be mixed with hydrogen gas in an inlet pipe and heated up to reaction temperature in a preheater or may be part of the recycle gas stream. High sulfur coals may not require an additional source of sulfur. The catalyst precursor treatment is suitably conducted for a period ranging from about 5 minutes to about 2 hours, preferably for a period ranging from about 10 minutes to about 1 hour, depending on the composition of the coal and the specific catalyst precursor used. Such a thermal treatment in the presence of a reducing gas (hydrogen or carbon monoxide) or in the presence of a reducing gas and hydrogen sulfide converts the metal compound to the corresponding metal-containing sulfide catalyst which acts also as a coking inhibitor.

Another method of converting a catalyst precursor or oil-soluble metal compound to a catalyst for use is the present process is to react the mixture of metal compound, coal extract and solvent with a hydrogen-containing gas in the hydroconversion zone, itself at coal hydroconversion conditions.

Although the oil-soluble metal compound (catalyst precursor) is preferably added to a solvent, and the catalyst formed within the mixture of coal extract and solvent, it is also possible to add already formed catalyst to the solvent, although as mentioned above, the dispersion may not be as good.

In any case, a mixture of catalyst, solvent, and coal extract is sent to the hydroconversion zone which will now be described. The coal hydroconversion zone is maintained at a temperature ranging from about 650 to 950° F., preferably from about 650 to 850° F., more preferably between about 725 and 800° F., and a hydrogen partial pressure ranging from about 500 psig to about 5000 psig, preferably from about 1200 to about 3000 psig. The space velocity, defined as the volume of the coal and solvent feedstock per hour per volume of reactor (V/H/V), may vary widely depending on the desired conversion level. Suitable space velocities may range broadly from about 0.1 to 10 volume feed per hour per volume of reactor, preferably from about 0.25 to 6 V/H/V, more preferably from about 0.5 to 2 V/H/V.

The 650° F.+ bottoms from the hydroconversion stage may be recycled, in part, back to the hydroconversion zone, if desired, to increase conversion by 650° F.+ bottoms reaction to extinction. The 1000° F.+ bottoms which are purged are preferably gasified, for example by partial oxidation, along with the residue from the extraction, to produce hydrogen, carbon monoxide and heat.

With bottoms recycle, a suitable solvent:coal extract:-bottoms 1000° F.+ ratio by weight to the hydroconversion zone will be within the range of about 2.5:1:0 to about 0.5:1:2. Reducing the solvent to solids ratio improves the thermal efficiency of the process because the reactor size is reduced for a given coal throughput, or allows for more throughput. A typical process solvent boiling range is from 450 to 650° F. IBP to about 1000° F. FBP.

The range of process conditions recommended for the hydroconversion stage, according to an embodiment considered the best mode, is summarized in Table 1 below:

TABLE 1

| Variable | Broad Range | Preferred Range |
|---|---|---|
| Hydroconversion Temp., °F. | 650-950 | 650-800 |
| Pressure, psig | 500-5000 | 1200-3000 |
| Slurry, Residence Time, Min | 25-480 | 60-240 |
| Solvent/Extract Ratio, by wt | 0.5-2.5 | 0.8-1.2 |
| Bottoms/Extract Ratio, by wt | 0-2 | 0-1.5 |
| $H_2$ treat, wt % on extract | 4-12 | 6-10 |
| Sulfur on Extract, wt % | 0-10 | 0-4 |
| Solvent Boiling Range, °F. | 450-1100 | 650-1000 |
| Catalyst Metal on Extract, wppm | 100-100,000 | 100-20,000 |

A conversion of greater than 90% to various products based on wt% daf coal can be achieved. As noted above, however, high catalyst loading can offer significant improvements, for example, better liquids selectivity and conversion with a corresponding decrease in gas yield. Normally, low hydroconversion temperature results in low coal extract reactivity. However, hydroconversion reactivity which allows good conversion and good liquids selectivity can be achieved at lower temperatures by high catalyst loadings and/or when the coal is first pretreated in the above-described manner.

The process of the invention may be conducted either as a batch or as a continuous type process. Suitably, there are on-site upgrading units to obtain finished products, for example transportation fuels.

DESCRIPTION OF THE DRAWING. Referring now to FIG. 1, pulverized coal is introduced by line 1 into a mixing and pretreatment zone 3 wherein the coal is mixed with carbon monoxide and an organic solvent introduced by lines 6 and 5, respectively. This coal mixture is subjected to elevated temperature and pressure conditions as described heretofore. The gases remaining or produced in the pretreatment zone, typically $CO_2$, CO, $H_2O$, $H_2$ and $C_1$-$C_4$ hydrocarbons, are removed via line 15.

Following pretreatment, the coal enters an extraction zone 4. (As mentioned above, in an alternate embodiment, the extraction of the coal may take place concurrently in pretreatment zone 3.) The extraction may be carried out in staged units. In passing to, or after the coal is passed into, the extraction zone 4, additional solvent may be introduced by line 22. Sufficient solvent may be introduced into the extraction zone in order to obtain a total solvent to coal weight ratio at conditions of from about 1:1 to 5:1, preferably about 2:1. The residence time of the coal ranges from about 10 minutes to 2 hours, preferably about 20 minutes. A suitable temperature is 200° F. to 650° F., preferably 350° F. to 650° F., most preferably 500° F. to 650° F.

Typically, a pressure of 500 psi can be maintained in the extraction zone in order to keep the solvent from volatizing. However, some solvents, especially process derived solvents such as coal distillate or VGO, can be kept under much lower pressures.

It is preferred that no less than 70% by weight dry ash free treated coal be extracted. A suitable range is 70 to 100%, preferably 80 to 100%.

In the extraction zone, the coal mixture is agitated, whereby a hydrocarbonaceous material is extracted from the coal material and taken into solution in the solvent leaving a solid coal residue comprising insolubles and ash. Converting the coal material into a soluble form minimizes or precludes regressive reactions in hydroconversion that lead to refractory bottoms.

The mixture of solvent, extract and residue is then passed into a first separation zone 16, where the mixture is separated into a liquid or solvent phase, in line 18, containing all of the solvent soluble hydrocarbonaceous product components (substantially all of the solubles from the coal) and a solids-containing phase, in line 20, containing all of the solvent insoluble hydrocarbonaceous material (substantially all of the ash from the coal) charged to the extraction zone 4. Separation can be readily accomplished by use of a filter means or centrifuge. The solvent insolubles-containing phase is typically a solid, its make-up depending upon the composition of the particular coal used in the operation. In a second separation zone 24, a part or all of the solvent may be separated from the solvent soluble hydrocarbonaceous product by fractionation. Since the solvent soluble hydrocarbonaceous product generally has an initial boiling point substantially higher than the boiling point of the solvent, it is conveniently separated from the solvent in a distillation column. The separated solvent may be recycled back to the extraction zone (alternatively to the pretreatment zone) via line 26 for admixture with the pretreated coal.

Figure 2:
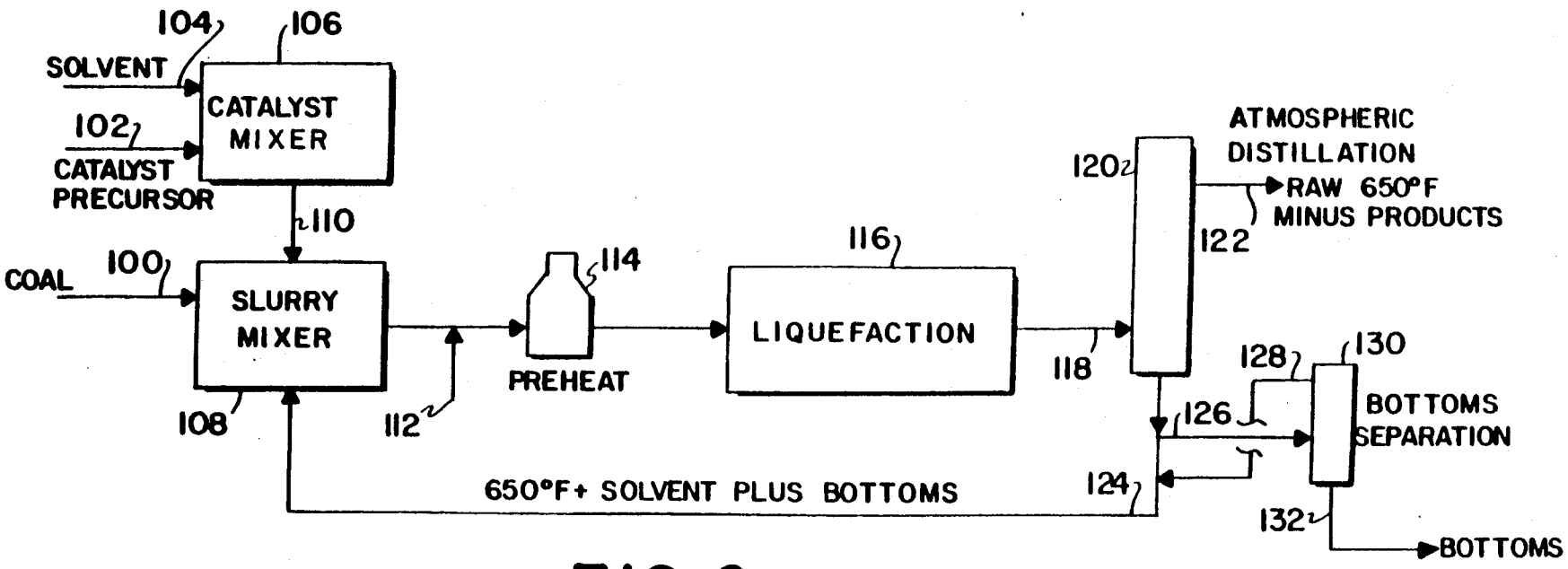
FIG. 2 shows a process flow diagram illustrating a process for upgrading a liquid effluent of a hydroconversion reactor.
Figure 3:
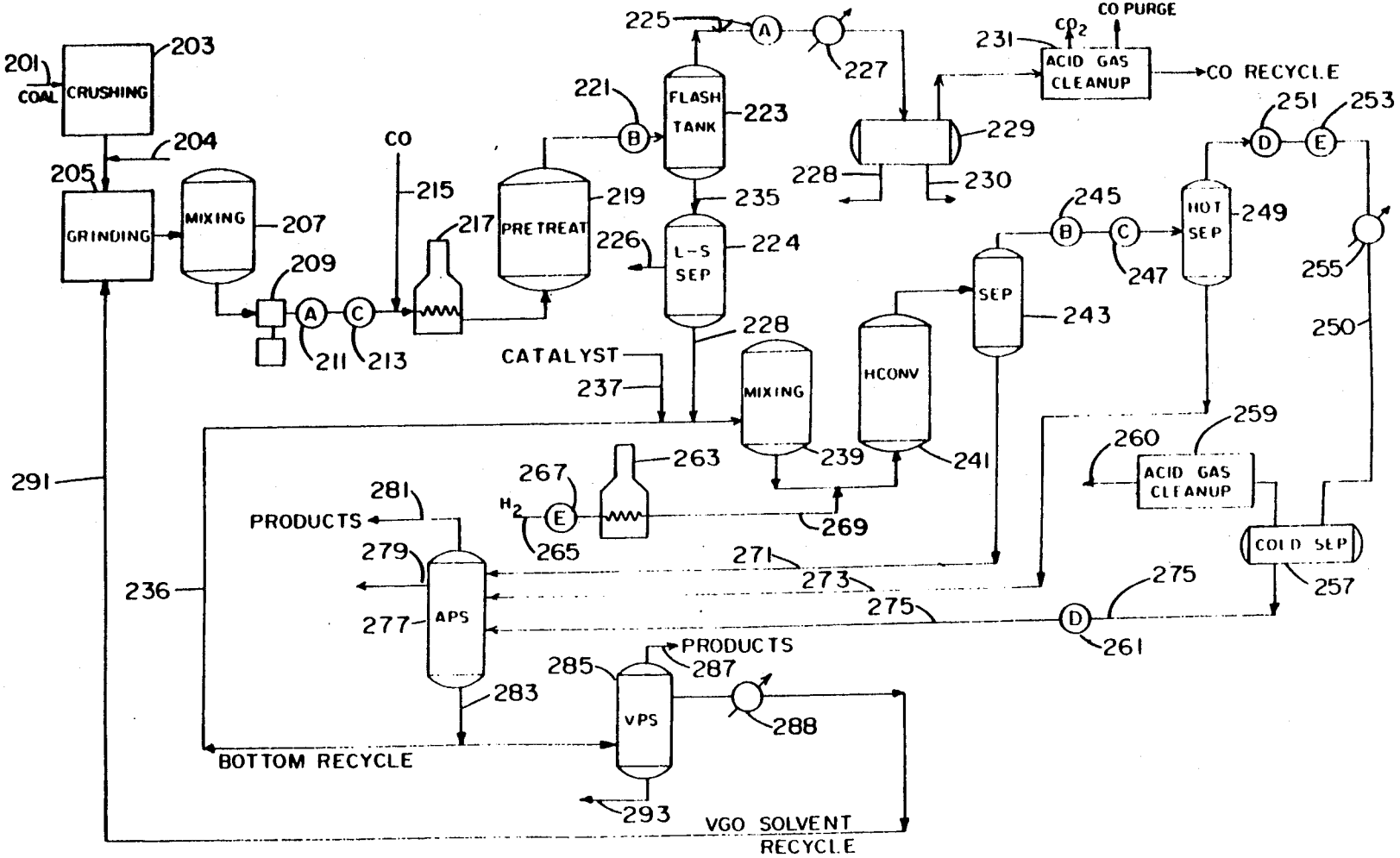
FIG. 3 shows a process flow diagram of an exemplary process according to the present process.

The coal extract phase is introduced into a mixing zone 17 (analogously in FIG. 2, the coal extract in line 100 is introduced into slurry mixer 108), wherein additional solvent and bottoms are added by line 21 (124 in FIG. 2) to the extract. Additionally, recovered solvent from downstream can be introduced via line 19 (128 in FIG. 2). A catalyst precursor-containing solvent is introduced into the mixing zone 17 via line 23. In FIG. 2, a solvent stream 104 and catalyst precursor 102 are introduced into a catalyst mixing zone 106. The components in the mixing zone are intimately mixed to form a homogenous mixture.

The mixture of oil-soluble metal catalyst precursor, solvent, and coal extract is introduced into a preheating zone 114 as shown in FIG. 2. A gaseous mixture comprising hydrogen, and optionally hydrogen sulfide, is introduced into this zone via line 112. The preheating zone is suitably maintained at a temperature ranging from about 600–700° F. and a pressure of about 2000–2500 psi.

The coal extract and catalyst slurry are then introduced into a hydroconversion zone 29 of FIG. 1 (or 116 in FIG. 2). The hydroconversion reactor may be any suitable vessel or reactor capable of withstanding the desired temperature and pressure hydroconversion conditions. Typically, there are a plurality of staged hydroconversion reactors (not shown), the conditions of each reaction zone being set to maximize desired equilibrium limits and kinetic rates and to obtain the best profile of products.

The feed to the hydroconversion zone is typically in a 0.5:1 to 1:1 ratio of solvent to coal extract by weight. Make-up solvent may be introduced as needed. Preferably, the solvent may be sent to the hydroconversion zone and recycled following hydroconversion. A 1:1:1 solvent-to-coal extract-to-bottoms recycle to the hydroconversion zone is suitable. It is preferred to recycle as much 650° F.+ liquids as possible to maximize the yield of lighter liquids.

The product of the overall hydroconversion process is significantly improved compared to the base process (the base process referring to an overall process without the pretreatment stage and/or coal extract separation). For example, a typical conversion to 1000° F.− product, for a catalytic hydrogenation hydroconversion base process, was about 75%, based on the DAF weight % of original coal feed. A typical product (from Wyoming sub-bituminous coal) comprised about 14% $C_1$–$C_4$ gas and 43.69% $C_5$–1000° F.— liquid (12% naphtha, 29% distillate and 9% VGO in the 1000° F.− of boiling point range). Hydrogen consumption was about 5.3% on daf feed coal. In comparison, by adding an carbon monoxide pretreatment stage, the gas make and hydrogen consumption will decrease and the amount of naphtha and distillate in the product will increase. By separating a coal extract as well, the gas make and hydrogen consumption will further decrease and the amount of naphtha and distillate will further increase. The increased amount of naphtha produced by the use of pretreatment and extraction steps will therefore be particularly pronounced.

Referring again to FIG. 1, a hydrogen-containing gas is introduced directly into hydroconversion reactor 29 or alternatively, before the reactor via line 31 for temperature control purposes. Suitable hydrogen-containing gas mixtures for introduction into the hydroconversion zone include raw synthesis gas, that is, a gas containing from about 5 to about 50 mole hydrogen, preferably from about 10 to 30 mole % carbon monoxide. Another suitable hydrogen-containing gas is obtainable from the steam reforming of natural gas. Pure hydrogen if available is also suitable.

Preferably, a portion of the hydrogen needed for hydroconversion is provided by a partial oxidation unit 33. The remainder of the hydrogen may be generated by conventional coal partial oxidation or natural gas reforming. A suitable partial oxidation process is disclosed in U.S. Pat. No. 3,528,930. In that process, coal or a coal fraction is pumped into a partial oxidation reactor, essentially a gasifier, in the form of small droplets of water slurry, where it is mixed with oxygen (for example, from an oxygen plant) and steam. The amount of oxygen is adjusted so that oxidation of the coal material all the way to $CO_2$ primarily does not occur. Some $CO_2$ is made, necessarily, to provide process heat for the main reactions, which are, in the net, endothermic. These reactions are as follows:

$$2C + O_2 \rightarrow 2CO$$

$$C + H_2O \rightarrow CO + H_2$$

The mixture of CO and $H_2$ produced, known as "synthesis gas" can be sent to a PRISM membrane unit 41 (registered trademark of Monsanto Corporation), following acid gas removal in separator 35. $H_2$ is separated and removed via line 43, and the CO in line 6 is used for the pretreatment step. In addition, some of the gases from the partial oxidation unit can be passed over a Ni catalyst and contacted with additional water in reactor 39 to shift CO and produce $CO_2$ and additional $H_2$ for plant needs, according to the following water gas shift reaction:

$$CO + H_2O \rightleftharpoons CO_2 + H_2$$

Following acid gas removal in separator 37, $H_2$ is obtained in line 47. The hydrogen in lines 43 and 47 can be used in the hydroconversion reaction zone.

Returning to the hydroconversion zone 29 in FIG. 1, the effluent in line 49 comprises light gases, an oil product, bottoms, and catalyst slurried together. The effluent is passed to a separation zone 51 (including atmospheric pipestill) from which gases are removed overhead by line 53. The gases typically comprise $C_1$–$C_4$ hydrocarbons, $H_2$, and acid gases. The $C_1$–$C_4$ gases may be used as fuel, for example to preheat the coal. The $H_2$ may be recycled to the coal hydroconversion zone via lines 53 and 31 or used for upgrading the liquid products. The gases may be first scrubbed by conventional methods to remove any undesired amounts of hydrogen sulfide, ammonia, water and carbon dioxide.

The slurried effluent from hydroconversion zone 29 is separated in zone 51 by conventional means, e.g., distillation, into a first stream comprising a hydrocarbonaceous oil (atmospheric boiling point below about 650° F.), which is sent via line 57 to a fractionation zone 61, and a second stream comprising a slurry of heavy liquids, solvent, and catalyst (atmospheric boiling point above about 650° F.+). This slurry is divided between recycle lines 21 and 55, in a ratio which is determined by the desired solids purge rate and/or the desired amount of solvent make-up. In line 21, the slurry is recycled directly back to mixing zone 17 for reuse in the hydroconversion zone. This is desirable to increase conversion and recycle catalyst. In line 55, slurry is carried to vacuum separator 59, where the heavy solvent (atmospheric boiling point 650°0 F. to 1000° F.) is separated from the residua by vacuum distillation. The heavy solvent is recycled via line 19 to either mixing zone 17 or to extraction zone 4. The residua may be sent to optional catalyst recovery zone (not shown), or disposed of in an environmentally acceptable manner. Since the solid residue is essentially ash free, the catalyst recovery zone can readily yield catalyst for reuse, for example, in mixing zone 17.

The hydrocarbonaceous oil produced in the hydroconversion zone is removed from separation zone 51 by line 57 and passed to a fractionation zone 61, wherein various boiling range fractions can be obtained. Depending on the catalyst loading in the hydroconversion zone, these fractions may be sent to upgrading zone (not shown), where treatment with hydrogen, optionally in the presence of a hydrotreating catalyst, yields a final product in line 67. In an alternate embodiment of the present invention, at least a portion of the oil product is recycled in line 21 to extraction zone 4, providing a lighter solvent for the extraction step.

Various process options for treating the liquid effluent which is removed from the hydroconversion reactor 29 are possible and will be recognized by those skilled in the art. For example, referring to FIG. 2, a preferred embodiment is shown for treating the liquid products. The liquid effluent 118 from hydroconversion reactor 116 is fractionated in an atmospheric fractionator 120 into raw 650° F.− products in line 122. A portion of the atmospheric bottoms is recycled in recycle stream 124 in the desired ratio with coal extract and catalyst. The atmospheric bottoms not required for recycle to hydroconversion are routed in line 126 to a bottoms separator 130 to recover additional 650° F.+ liquids in line 128 for use as solvent. This separator 130 may be a vacuum distillation tower, solvent extraction unit, etc. The residual vacuum bottoms in line 132 can be utilized as feed, separately or blended with coal, to a partial oxidation unit, a hybrid boiler, or a conventional boiler for process heat or hydrogen.

The recycle atmospheric bottoms stream contains active, well-dispersed microcatalyst. Make-up catalyst is needed to maintain catalyst concentration due to loss of catalyst purged with the bottoms.

In another embodiment, a fractionator following the hydroconversion zone may be used to separate the effluent into a light liquid or naphtha, $C_5$ to 400° F., a distillate at 400–650° F. and a solvent at 650–1000° F. The solvent is preferably recycled to the hydroconversion reactor and/or the extraction reactor, and the bottoms from the fractionator can be recycled to the hydroconversion reactor, sent to the partial oxidation unit, or purged.

The following example illustrates a preferred embodiment and certain advantages of the present process. This example is not intended to limit the broad scope of the present invention. Other advantages and embodiments of the present invention will be apparent to those skilled in the art from the description provided herein.

EXAMPLE 1

The following is a prophetic process design for carrying out the invention. Reference is made to FIG. 5. As-received coal is introduced via line 201 into a crushing zone 203, where the coal is crushed in a conventional ball or rod mill to less than about ¼ inch in diameter particles. If the as-received coal is very wet, the coal may be dried in a conventional gas swept drier in order to prevent agglomeration during crushing. Following the crushing zone 203, it is optional to spray the coal with a chemical promoter solution, introduced through line 204, to promote the subsequent pretreatment step. The crushed coal is then mixed with solvent (also referred to as "hot oil") in a solvent-to-dry coal ratio of about 1.5:1 and at a temperature of about 225° F. in hot oil grinding zone 205. This grinding step can be carried out in a conventional hot oil ball mill and reduces the coal slurry to a paint-like consistency with coal particles of about −100 to −200 mesh. The temperature of the hot oil solvent is such as to maintain it at a pumpable viscosity. The coal slurry then enters a mixing and/or hold-up tank 207, before being raised in pressure by pump 209. The pressurized coal slurry passes through heat exchangers 211 and 213. (The heat exchangers in FIG. 5 are designated with matching letters A, B, C, etc. to indicate where heat and cold sinks may be heat exchanged to optimize the thermal efficiency of the process.) Carbon monoxide is mixed with the coal slurry via line 215 and the coal slurry is further elevated in temperature by furnace 217 before entering pretreatment zone 219 for a residence time of about 90 minutes. The pretreatment zone is at a pressure of 3500 psi and a temperature of 600° F. The pretreated coal is further heated in heat exchanger 221 or furnace to a temperature of 675° F. and enters a flash tank 223 at a pressure of 2600 psi. The gaseous effluent from the flash tank is cooled in heat exchanger 225 and cooling water exchanger 227 to a temperature of 110° F., and condensed liquids are accumulated in tank 229, where two immiscible liquid phases form; a light solvent phase in line 228, which may be sent to the atmospheric pipestill, and a water phase (in line 230) containing soluble organics, which organics may be extracted out and sold for use in various products. The uncondensed gases from tank 229 are treated in an acid gas cleanup zone 231 to remove $CO_2$ and the remaining CO may be recycled to the pretreatment zone 219 or purged to a water-gas-shift reaction to make plant hydrogen. The liquid effluent, comprising a 1.8:1 weight ratio of solvent to coal extract, is removed from the flash tank 223 by line 235, and is introduced into a liquid-solid separation zone 224, wherein solid residua is disposed of via line 226, and preferably sent to a partial oxidation unit. The separated liquid (coal extract) phase, comprising the coal solubles, are removed by line 228 and admixed with a solvent atmospheric bottoms recycle in line 236. Catalyst for the hydroconversion reactions is introduced into the coal extract via line 237. The coal extract and catalyst slurry then enters a mixing zone 239 at a temperature of 675° F. and a pressure of 2550 psi. A small amount of hydrogen may be added to the mixing zone to prevent regressive reactions. The mixed coal extract and catalyst slurry receives molecular hydrogen gas from a treat gas in line 269, which treat gas is supplied via line 265 and heated by furnace 263 and heat exchanger 267. The treat gas is heated to help raise the temperature of the overall mixture to meet hydroconversion conditions. The mixture of coal extract, solvent, treat gas and catalyst enters the hydroconversion zone 41, where it is subjected to a temperature of 800° F. and a pressure of 2500 psig for a period of about 90-120 minutes and at a ratio of solvent to treated coal extract to recycle bottoms of 1.8:1:0.5. One or a series of hydroconversion reactors may be employed. The effluent from the reactor 241 enters a gas-liquid separator 243, wherein the separated liquids are sent to atmospheric pipestill 277. The gases from gas-liquid separator 243, after being cooled in heat exchangers 245 and 247, enter a hot separator 249 at a temperature of 650° F. A condensed liquid phase is removed from hot separator 249 via line 273 and sent to an atmospheric pipestill 277. The uncondensed gases, after passing through heat exchangers 251 and 253 and cooling water exchanger 255, are sent via line 250 to a cold separator 257, where uncondensed gases are removed by line 260 following acid gas cleanup in zone 259. The gas stream can then be split (not shown) to make a recycle stream with hydrogen and a purge stream for hydrogen recovery. The condensed liquids from cold separator 257 are removed in line 275 and, after passing through heat exchanger 261, sent to the atmospheric pipestill 277. The atmospheric pipestill 277, which receives the liquid products from the hydroconversion reactor 241 and separator 229, produces an overhead gaseous stream 281 and a product stream 279, which may be sent to a hydrotreating zone (not shown) for final treatment. A portion of the bottoms from the atmospheric pipestill is sent via line 283 to a bottoms recycle stream 236 which, as described above, is mixed with the coal extract and catalyst before hydroconversion. Another portion of the bottoms is sent to vacuum pipestill 285, where a further product stream 287 for hydrotreatment is produced. A bottoms stream 293 from the vacuum pipestill is sent as feed to a partial oxidation unit to produce part of the required CO and $H_2$. The vacuum pipestill 285 produces a distillate with a boiling point of 650° to 1000° F., which distillate forms a VGO (vacuum gas oil) recycle stream. After passing through heat exchanger 288, the VGO is recycled via line 291 for admixture with in-coming coal in the hot oil grinding zone 205, as mentioned above.

It will be understood that while there have been herein described certain specific embodiments of the invention, it is not intended thereby to have it limited to or circumscribed by the details given, in view of the fact that the invention is susceptible to various modifications and changes which came within the spirit of the disclosure and the scope of the appended claims.

What is claimed is:

1. A process for hydroconverting coal to produce a hydrocarbonaceous liquid, which comprises:

(a) in a pretreatment zone, forming a slurry of water-containing coal in an organic solvent, wherein the ratio of water-to-dry coal at conditions is below 0.5:1 and the ratio of organic solvent-to-dry coal is 4:1 to 1:1, and subjecting the slurry to an effective amount of carbon monoxide at a temperature in the range of 550°-700° F. and an elevated pressure to cause deploymerization and hydrogenation of the coal thereby increasing the coal's solubility in the solvent and to extract a portion of the coal into the organic solvent;

(b) separating the pretreated coal slurry into two phases, an organic solvent phase comprising a substantial amount of soluble hydrocarbonaceous materials extracted from the coal, and a second solid residue phase comprising substantially all of the inorganic ash from the coal;

(c) forming an essentially ashless mixture comprising said extract and a catalyst, wherein the catalyst is comprised of dispersed particles of a sulfided metal containing compound, said metal being selected from the group consisting of Groups VA, VIA, VIIA and VIIIA of the Periodic Table of the Elements and mixtures thereof;

(d) reacting the essentially ashless mixture of coal extract and catalyst with a hydrogen-containing gas under coal hydroconversion conditions, in a hydroconversion zone to obtain a hydrocarbonaceous liquid; and (e) hydrotreating at least an portion of the hydrocarbonaceous liquid from step (d) to produce an upgraded product.

2. The process of claim 1, wherein following the pretreatment of step (a), the pretreated coal slurry is further extracted in an extraction zone prior to separation of the coal material in step (b) into solid and liquid phases.

3. The process of claim 1, wherein the inlet ratio of water-to-dry coal in step (a) is below about 1:1.

4. The process of claim 1, wherein said hydroconversion zone is at a temperature of 650° to 950° F.

5. The process of claim 1, wherein said hydroconversion zone is at a temperature between about 650° and 800° F.

6. The process of claim 1, wherein said pretreatment zone is at a temperature of 600° to 675° F.

7. The process of claim 1, wherein said catalyst is a conversion product of an organic oil-soluble metal compound.

8. The process of claim 1, wherein said compound is molybdenum sulfide.

9. The process of claim 1, wherein the hydrocarbonaceous liquid is fractionated to obtain a liquid product and a solvent for recycle.

10. The process of claim 1, wherein the coal extract of step (b) is separated from a residue comprising ash-containing coal solids by filtration, sedimentation, cycloning, centrifugation, or settling.

11. The process of claim 10, wherein said residue is subjected to partial oxidation, whereby carbon monoxide for step (a) is produced and hydrogen for step (d) is produced.

12. The process of claim 1, wherein the organic solvent is a distillate boiling in the range of about 440 to 650° F. or a vacuum gas oiling boiling in the range of about 650 to 1000° F. or a combination thereof.

13. The process of claim 7, wherein the metal constituent of said oil soluble metal compound is selected from the group consisting of molybdenum, chromium and vanadium.

14. The process of claim 13, wherein said oil soluble metal compound is molybdenum naphthenate.

15. The process of claim 14, wherein said oil soluble metal compound is phosphomolybdic acid.

16. The process of claim 1, wherein an effective amount of catalyst is employed in step (d) to convert the extract to a nearly finished product characterized by a nitrogen level of 0 to 1500 ppm, a sulfur level of 200 to 4900 ppm, an oxygen level of 1300 to 15,000 ppm and a hydrogen-to-carbon ratio of at least about 1.7.

17. The process of claim 16, wherein the metal is present in said mixture at a concentration of between 1% and 10% by weight.

* * * * *